US005078071A

United States Patent [19]

Miura

[11] Patent Number: 5,078,071

[45] Date of Patent: Jan. 7, 1992

[54] FLOATING DOCK CAPABLE OF VARYING WIDTH

[76] Inventor: Nobutaka Miura, 5-4, Wakatakemachi, Nagasaki, Japan

[21] Appl. No.: 445,652

[22] PCT Filed: Mar. 30, 1989

[86] PCT No.: PCT/JP89/00334

§ 371 Date: Nov. 27, 1989

§ 102(e) Date: Nov. 27, 1989

[87] PCT Pub. No.: WO89/09162

PCT Pub. Date: Oct. 5, 1989

[30] Foreign Application Priority Data

Mar. 31, 1988 [JP] Japan ..... 63-80959
Feb. 6, 1989 [JP] Japan ..... 1-28439

[51] Int. Cl.[5] ..... B63B 35/44
[52] U.S. Cl. ..... 114/263; 114/45
[58] Field of Search ..... 114/263, 44, 45, 48, 114/46

[56] References Cited

U.S. PATENT DOCUMENTS 3,265,024 8/1966 Kramlich ..... 114/45
3,412,702 11/1968 Mann ..... 114/46
3,415,212 12/1968 Henning ..... 114/45
3,777,691 12/1973 Beale ..... 114/48
4,732,102 3/1988 Holman et al. ..... 114/45

FOREIGN PATENT DOCUMENTS 62-128896 6/1987 Japan .

*Primary Examiner*—Sherman Basinger
*Attorney, Agent, or Firm*—Jordan and Hamburg

[57] ABSTRACT

A floating dock has a trestle body including arcuate frame members for cradling a boat, float members which slide relative to the frame members and devices for moving the float members to and fro between positions alongside the trestle body so that the float members extend laterally beyond the width of the trestle body and below the trestle so that the trestle body extends laterally beyond the float members.

4 Claims, 9 Drawing Sheets

FLOATING DOCK CAPABLE OF VARYING WIDTH

BACKGROUND OF THE INVENTION

The present invention relates to a floating dock for mooring and storing small boats or the like above the water.

For maintaining and storing a small recreational boat, the boat is periodically landed to scrape off shells and seaweed from the hull thereof with a great deal of labor and expense, and thereafter to apply highly toxic fouling preventive coating thereto to attain a fouling preventive effect for the time being.

In addition to the expense of providing these measures periodically, fuel consumption is increased due to inefficient running of the boat prior to defouling and recoating.

In view of the foregoing, the present applicant has previously disclosed, in Japanese Patent Application Unexamined Publication No. 62-128896, a water trestle machine for small boats or the like in which when a boat is not in use, even on the sea, the entire hull can be always held above the water to avoid fouling of the hull, while when the boat is to be used, the boat can be easily lowered onto the water.

Such a water trestle machine for small boats or the like still has the following problem.

That is, in such a water trestle machine, floating members are located on opposite sides of the trestle body and the floating members are merely vertically moved up and down along the opposite sides, to place the hull in an upper trestle position and a lower trestle position. Therefore, the water trestle machine is required to be of a width which is much wider than the hull to be moved upwardly or downwardly.

This requires a wide mooring space in a wharf, and as a result, the number of mooring units which can be installed in the wharf is restricted.

It is an object of the present invention to provide a floating dock of which width can be varied.

SUMMARY OF THE INVENTION

The present invention relates to a floating dock capable of varying in width comprising a trestle body formed at its upper surface with hull supporting surfaces, floating members disposed movably up and down in contact with sides of the trestle body, and a trestle body elevating device capable of moving the floating members from a first position located at both sides of the trestle body for floating the trestle body at a lower level to a second position located below the trestle body for floating the trestle body at a higher level.

DETAILED DESCRIPTION OF PREFERRED EMBODIMENTS OF THE INVENTION

For describing the present invention in further detail, the present invention will be described hereinafter in accordance with the embodiments shown in the accompanying drawings.

First Embodiment

Figure 1:
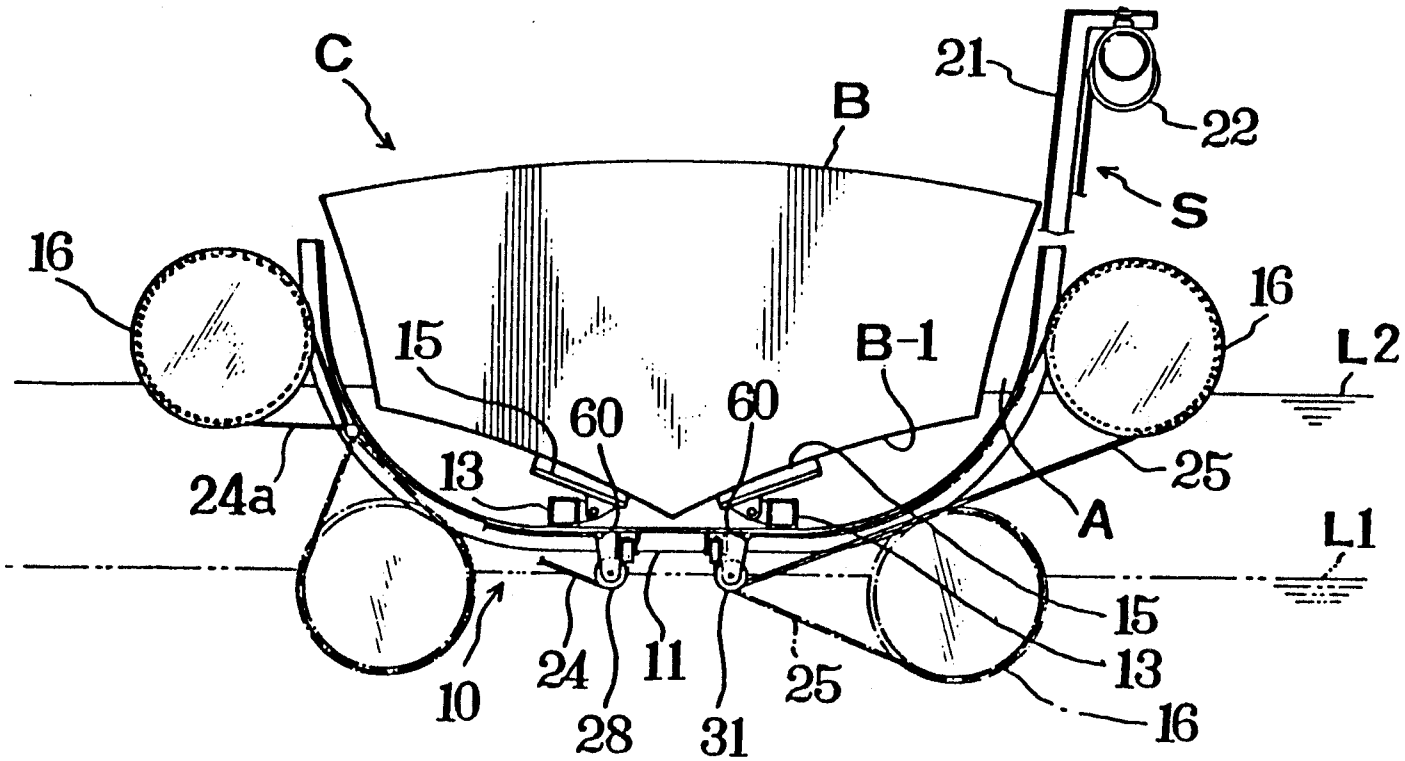
FIG. 1 is a front view of a floating dock capable of varying in width according to a first embodiment of the present invention.

FIG. 1 shows the entire construction of a floating dock C including a trestle body 10 which can place a small boat B or the like in an upper or a lower position. The trestle body 10 is floated in water by floating members 16 which will be described later. The trestle body 10 comprises, in the illustrated embodiment, a pair of front and rear frame members 11, 12 disposed in front and at rear in a parallel spaced apart relation, and a pair of connecting frame members 13 connected to a central portion of the front and rear frame members 11, 12 to form a frame body.

The front and rear frame members 11, 12 are designed so that their left and right portions are raised upwardly while being curved toward the central portion to form a U-shaped frame.

Figure 2:
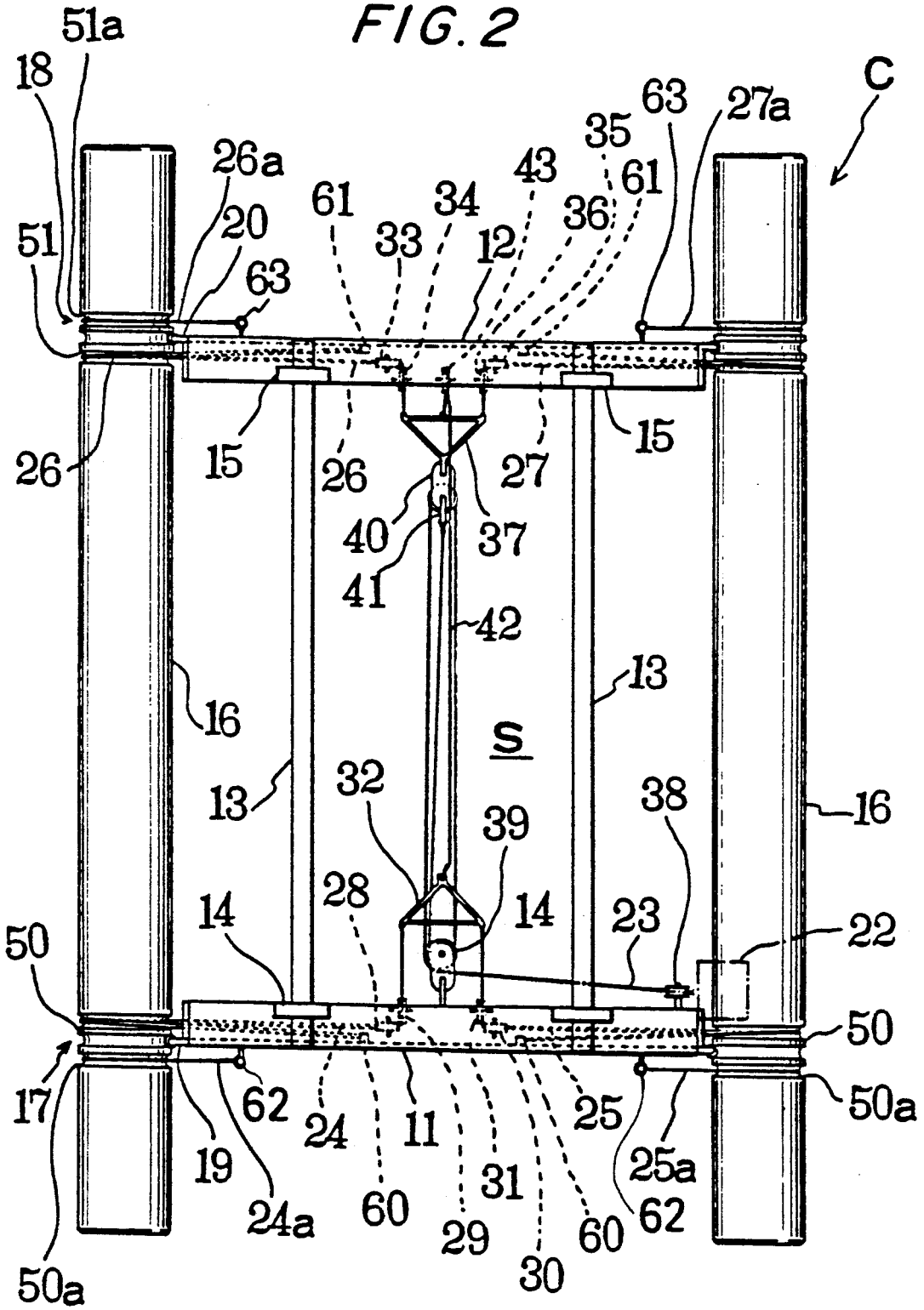
FIG. 2 is a plan view of the same.

As shown in FIGS. 1 and 2, hull supporting rods 14, 15 having supporting surfaces on which are supported front and rear portions of a bottom B-1 of a small boat B are mounted at the front and rear portions of the trestle body 10.

With such a construction as described above, the small boat B is supported on the trestle body 10 in a stabilized state as shown in FIG. 1.

The trestle body 10 is preferably formed of materials having high sea water-proof properties such as steel treated with anti-corrosive agents, stainless steel, sea water-proof aluminum, etc.

As shown in FIG. 1, the front and rear frame members 11, 12 of the trestle body 10 have their opposite ends curved upwardly to provide rising portions, and a concave shaped boat mooring space A is formed on the trestle body 10, within which boat mooring space A the small boat B is moored as shown in FIG. 1.

Floating members 16 and the trestle body elevating device S which further comprise the subject matter of the present invention will be described hereinafter.

Along the opposite sides of the trestle body 10 there are juxtaposed a pair of elongated cylindrical floating members 16 extending in a longitudinal direction parallel to the connecting frame members 13 of the trestle body 10, the front and rear ends of each of the floating members 16 extending forwardly and backwardly of the front and rear frame members 11, 12 of the trestle body 10.

Each floating member 16 at front and rear portions thereof is formed with ring-like guide grooves 17, 18 at locations corresponding to the front and rear frame members 11, 12.

On the other hand, on the outer peripheral surfaces of the front and rear frame members 11, 12, at positions corresponding to the positions of the ring-like guide grooves 17, 18, guide projections 19, 20 are provided and such projections 19, 20 are in engagement with the ring-like grooves 17, 18.

When the floating members 16 are moved along the projections 19, 20 as shown in FIG. 1, the trestle body 10 is moved together with the small boat B to a higher level to create water line L1 or to a lower level to create water line L2. Of course, the trestle and boat move up and down relative to a fixed water level and it is apparent that it is only for convenience of illustration that the two water lines appear to be defined by movement of the water level rather than by movement of the trestle body 10 and boat B.

With respect to the floating member guide means, besides the above-mentioned guide means, convex fins can be provided on the floating members 16 in place of the ring-like grooves 17, 18 to engage guide projections on the front and rear frame members 11, 12. In short, any construction in which the floating members 16 can be guided and moved will suffice.

While in the present embodiment, the floating members 16 can be formed from hollow steel cans to which anti-corrosive agent is applied or cylindrical members made of foamed polystyrene, it is to be noted that other shapes and materials can be also used.

For example, as for materials, the floating members 16 can be formed of hollow or buoyancy material-filled fiber reinforced plastics or the like. It is economical to make the floating members 16 of a foamed material or the like wherein the surface thereof is coated with a vinyl film or the like and through the interior thereof extends a core material such as wood, steel pipe or the like.

Next, the construction of the trestle elevating device S for moving the floating members 16 upwardly and downwardly to position the trestle body 10 at water line L2 and at water line L1, respectively, will be described hereinafter.

As shown in the drawing, an elevating means 22 such as chain block is supported on a post 21 mounted upright on the front frame member 11 of the trestle body 10. The elevating means 22 cooperates with operating lines 23, 24, 25, 26, 27, etc. which will be described later to form the trestle elevating device S to move the floating members 16 between a position located at both sides of and a position located below the trestle body 10 so that the trestle body 10 can be elevated.

Figure 3:
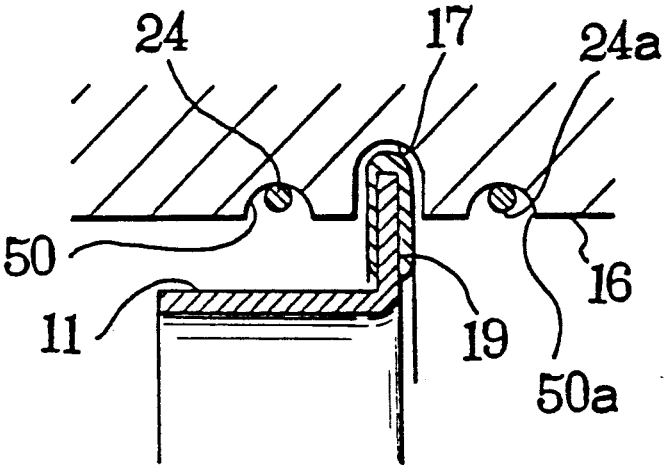
FIG. 3 is an enlarged view for explaining essential parts of a floating member guide construction.

That is, in FIG. 2, the operating lines 24, 25 are wound around the ring-like groove 50 provided at the front end of the floating members 16 (see FIG. 3). One end of the operating lines 24, 25 is tied to central portions 60 of the front frame member 11 while the other end thereof rearwardly extends through pulleys 28, 29, 30 and 31 provided in the central portion of the front frame member 11 and is connected to a triangular frame member 32.

On the other hand, the operating lines 26, 27 are wound around the ring-like groove 51 provided at the rear portion of the floating members 16.

One end of the operating lines 26, 27 is tied to central portions 61 of the rear frame member 12 while the other end thereof rearwardly extends through the pulleys 33, 34, 35 and 36 provided in the central portion of the rear frame member 11 and is connected to a triangular frame member 37.

The operating line 23 with one end connected to the elevating means 22 engages a pulley 38 mounted near one end of the front frame member 11 and is wound on a pulley 39 mounted centrally on the front frame member 11, and thereafter, the line 23 is wound on a running block 40 mounted on the triangular frame member 37 on the side of the rear frame member 12. Subsequently, the line 23 is again wound on the pulley 39 and, thereafter, the end thereof is tied to a ring 41 of the running block 40.

Reference numeral 42 denotes an operating line for connecting both triangular frame members 32, 37 through a pulley 43 provided in the central portion of the rear frame member 12 to provide a smooth movement of both triangular frame members 32, 37.

With the construction as described above, when the elevating means 22 is operated, the operating lines 23, 24, 25, 26 and 27 can be taken up or let out, whereby the floating members 16 can be moved up and down along the outer surfaces of the front and rear frame members 11, 12 to easily move the trestle body 10 to the water line L1 or the water line L2 shown in FIG. 1.

In the present embodiment, when the water line is at L1, the floating members 16 are positioned below the trestle body 10, and, therefore, the whole width of the floating dock C is approximately equal to that of the trestle body 10. Accordingly, the small boat B or the like can be moored in the minimum mooring space, and, as shown in FIG. 4, many floating docks can be moored in a compact manner at the wharf or the like.

Figure 4:
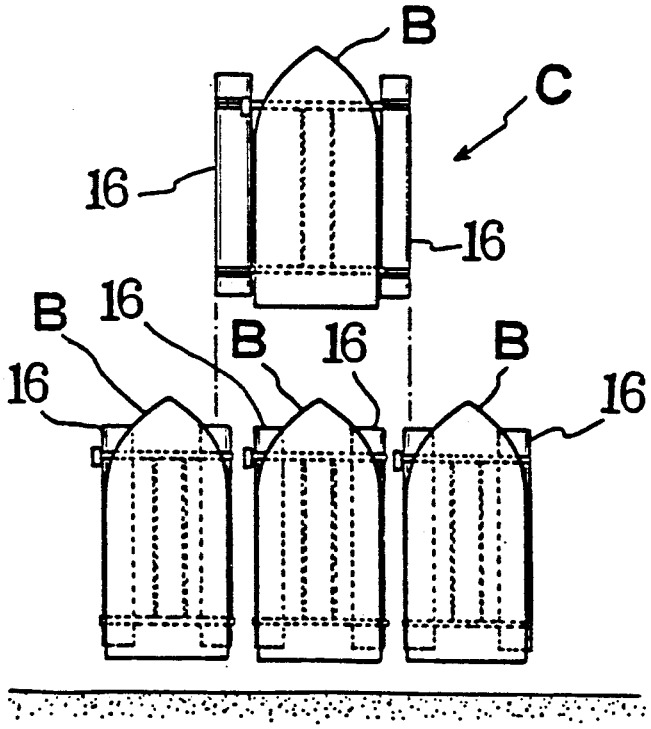
FIG. 4 illustrates the floating dock in use.

On the other hand, before adjusting the trestle body 10 from L1 to L2, the floating dock C has first been moved forwardly, as shown in FIG. 4, from the mooring space to a wider space adequate to permit movement of the floating members 16 up both sides of the trestle body 10 to thereby lower the trestle body 10 to L2.

Furthermore, in the present embodiment, since the elevating device S is provided with the running block 40, the elevating force required by the elevating means 22 is greatly reduced, and the elevating means 22 can be easily operated.

While in the present embodiment, a chain block is used as the elevating means 22, it is to be noted that the elevating means 22 is not limited thereto but other general lifting apparatuses such as electric or manual winches can be of course used as the elevating means 22.

In the present embodiment, reference numeral **50*a* designates a line guide groove for preventing disengagement of a floating member which is provided at a position away from the ring groove 50 at the front portion of the floating members 16. Lines 24*a*, 25*a* for preventing disengagement of a floating member are wound on both ends of the line guide groove 50*a*, the lines 24*a*, 25*a* having both ends tied to rings 62 provided on both ends of the front frame member 11. In FIG. 1 on the left side floating member 16 is shown with line 24*a* wound around groove 50*a* and fixing floating member 16 relative to the frame member 11 in its up and down positions. Note that the right side of FIG. 1 shows operating line 25 instead of line 24*a***.

On the other hand, reference numeral **51*a* designates a line guide groove for preventing disengagement of a floating member provided at a position away from the ring groove 51 at the rear of the floating members 16. Lines 26*a*, 27*a* for preventing disengagement of a floating member are wound on both ends of the line guide groove 51*a*, the lines 26*a*, 27*a* having both ends tied to rings 63 provided on both ends of the rear frame member 12**.

With the construction as described above, in moving the floating members 16, it is possible to positively prevent the floating members 16 from being disengaged from the front and rear frame members 11, 12.

Moreover, in lieu of the lines 26*a*, 27*a*, metal rings may be rotatably mounted in the line guide grooves 51*a* and may be connected to ring 63 by lines for preventing disengagement of a floating member 16.

Pulleys such as the pulleys 28, 29 include approximately semi-circular pulley-like members which are mounted unrotatably on the upper ends of the front and rear frame members 11, 12 and formed of nylon resins, phenol resins and other suitable resins having excellent wear resistance. The operating lines 15 or the like are slidably moved along the pulley-like members as described, and thereby shafts, bearings or the like which require precise working can be omitted. The smooth motion is obtained merely by somewhat increasing a tractive force of the elevating means 22 and the manufacturing cost is also reduced.

Since the pulley-like members are disposed in water, water is present between and decreases the friction between the pulley-like members and the operating lines 24, 25, 26, 27, etc.

Figure 6:
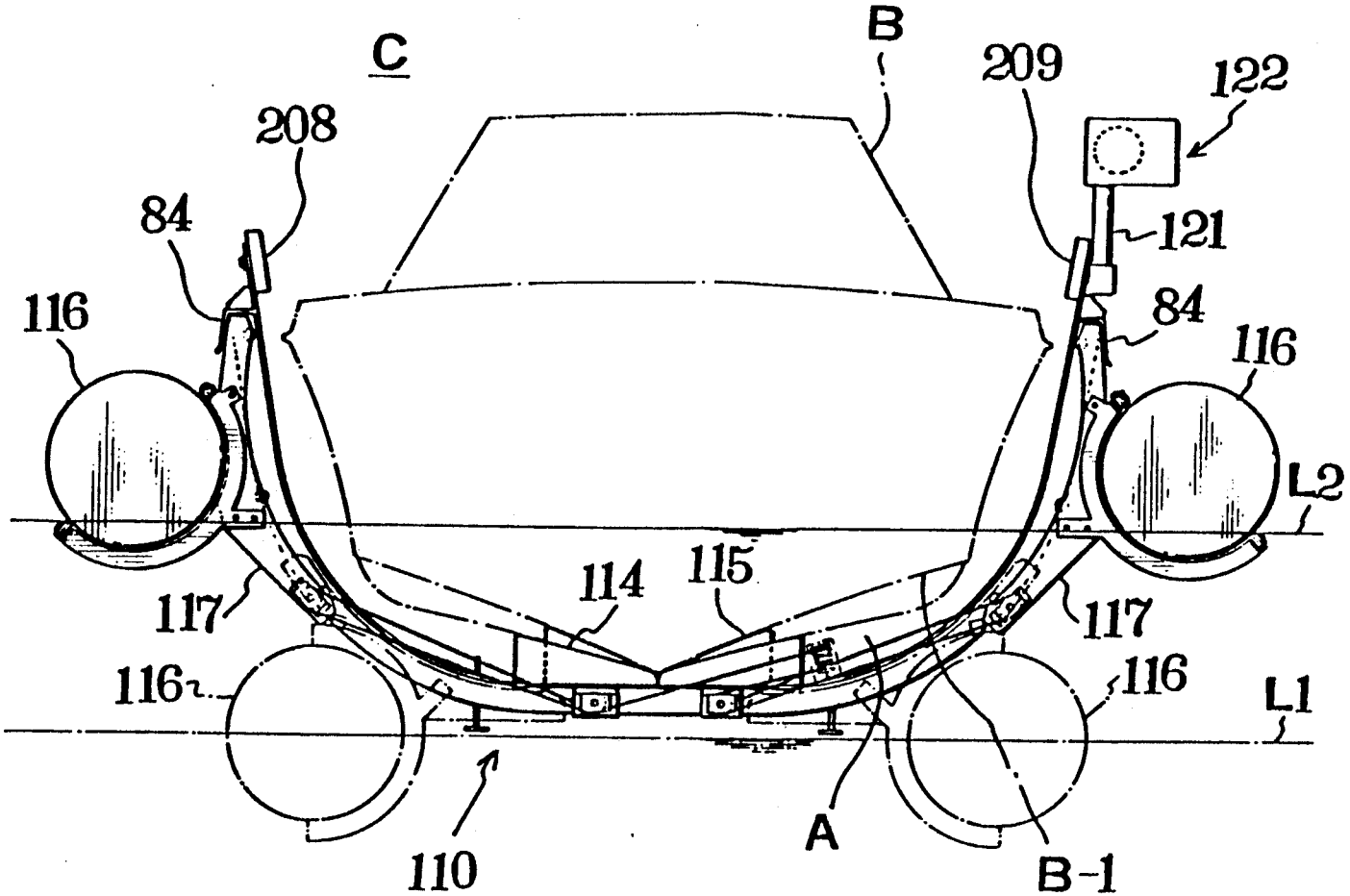
FIG. 6 is a front view of a floating dock according to a second embodiment of the present invention.

Instead of the provision of the ring-like groove 50 and the line guide groove 50*a*, bands with a groove having a recess-like section may be mounted on the periphery of the front and rear portions of floating members 116 so as to utilize the grooves of the bands as the ring-like groove 50 and the line guide groove 50*a* (see FIG. 6).

The method of using the floating dock C having the above-described construction will be described in detail with particular reference to FIG. 4.

First, preparatory to elevating the trestle body 10 and, therewith, the small boat B, a guide line or the like is secured to a guide rod or the like fixedly mounted on the trestle body 10 so that the center of gravity of the small boat B may be positioned approximately centrally between the front and rear frame members 11, 12, and the front and rear portions of the bottom B-I of the small boat B are supported on the upper ends of the hull supporting rods 14, 15.

Then, the elevating means 22, which comprises a chain block, is operated to wind up the operating line 23, and the operating lines 23, 24, 25, 26 and 27 are tensioned and wound up. Due to the tension exerted, the floating members 16 are moved downwardly along both side surfaces of the front and rear frame members 11, 12 to move the trestle body 10 upwardly until the hull of the small boat B on the hull supporting rods 15 has been raised to a level above the water for storage.

A separate line with a hook is suspended from the support post 21 for the elevating means, and the line can be supported at a suitable position to be used as a stopper.

Since the elevating means 22 composed of a chain block includes a known reverse rotation preventive mechanism, the operating line 23 or the like is not automatically unwound.

In lowering the small boat in order to launch it, when the stopper is released and the elevating means 22 composed of a chain block is reversely operated to loosen the operating line 23 or the like, the small boat B is moved downwardly by its own weight, and when the bottom B-1 of the boat B leaves the hull supporting rods 14, 15, the small boat B assumes the launched state.

Figure 5:
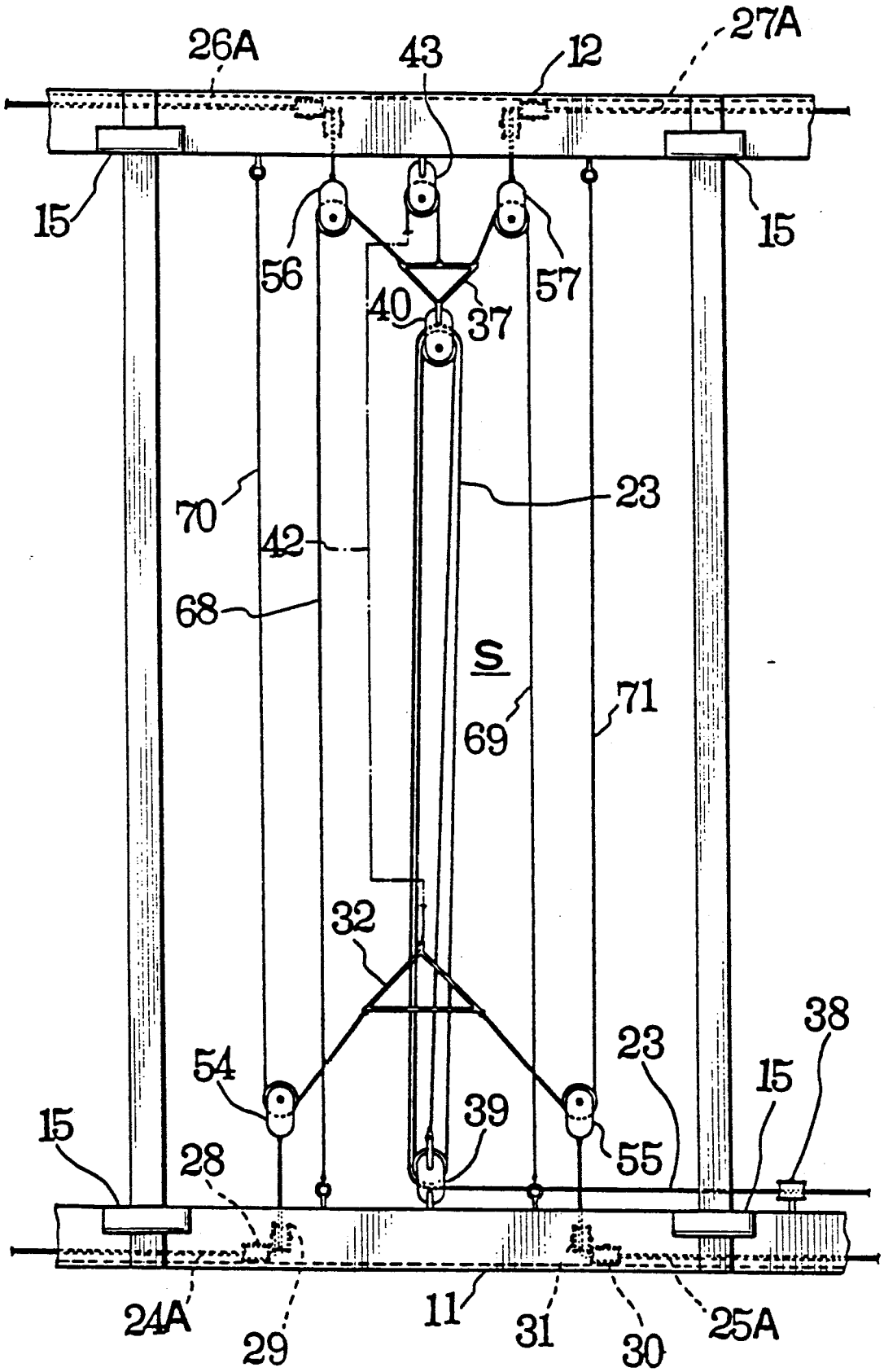
FIG. 5 illustrates a modified example of a floating dock.

FIG. 5 shows a modified example of the floating dock C according to the present invention, for handling a relatively large load, in which the tractive force required by the elevating means 22 is further reduced so that the elevating work can be done smoothly.

That is, in FIG. 5, the structure comprises operating lines 68, 69, 70 and 71 connected to the triangular frame members 32, 37 in such a manner that operating lines 24A, 25B, 26C and 27D corresponding to the operating lines 24, 25, 26 and 27 in the embodiments shown in FIGS. 1 and 2 are not directly connected to the triangular frame members 32, 37 but one end thereof is tied to the movable pulleys 54, 55, 56 and 57 around which the lines 70, 71, 68, and 69 are wound, one end of the lines 70 and 71 being tied to the rear frame member 12 and the other end being tied to the triangle 32 and one end of the lines 68 and 69 being tied to the front frame member 11 and the other end being tied to the triangle 37.

As described above, in case of a relatively heavy load, many pulleys and line means can be used to extremely lighten the load. However, in this case, since the length of the line means becomes long, winches are desirable as elevating means.

Second Embodiment

Figure 7:
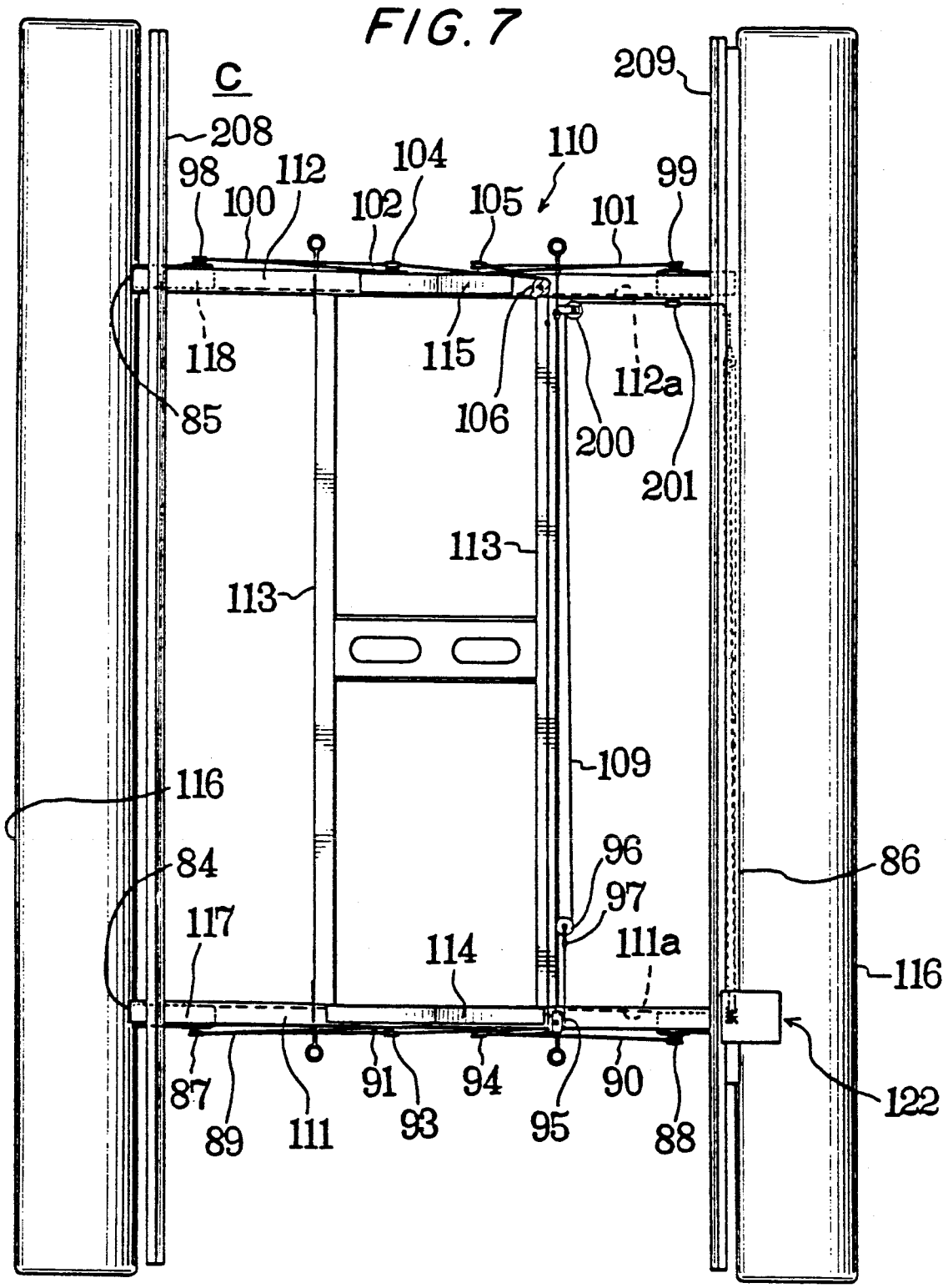
FIG. 7 is a plan view of the same.

FIGS. 6 and 7 show another embodiment of the whole structure of the floating dock C capable of placing the trestle body 110 and therewith the small boat B or the like at upper and lower positions.

In the illustrated embodiment, the trestle body 110 comprises a pair of front and rear frame members 111 and 112 disposed in front and at rear in parallelly spaced apart relation, and a pair of connecting frame members 113 connected to the central portion of the front and rear frame members 111 and 112 to form a frame body.

As shown in FIGS. 6 and 7, hull supporting rods 114, 115 having supporting surfaces capable of supporting the front and rear portions of the bottom B-1 of the small boat B are mounted at the front and rear portions of the trestle body 110.

With such a structure as described above, the small boat B is supported on the trestle body 110 in a stabilized state as shown in FIG. 6.

The trestle body 110 is preferably formed of materials having a high sea water resistance such as steel treated with anti-corrosive agent, stainless steel, and sea water-resisting aluminum.

As shown in FIG. 6, the front and rear frame members 111 and 112 of the trestle body 110 have their both ends curved upwardly to define a concave boat mooring space A above the trestle body 110 similarly to the first embodiment. The small boat B is moored within the boat mooring space A as shown in FIG. 6.

Floating members 116 and the trestle body elevating device S which further comprise the subject matter of the present invention will be described hereinafter.

As shown in FIG. 6, the trestle body 110 has a pair of elongated cylindrical floating members 116 extending in a longitudinal direction parallel with connecting frame members 113 of the trestle body 110 and juxtaposed at opposite sides thereof, each of the floating members 116 having its front and rear ends extended forwardly and rearwardly of the front and rear frame members 111, 112 of the trestle body 110.

Figure 8:
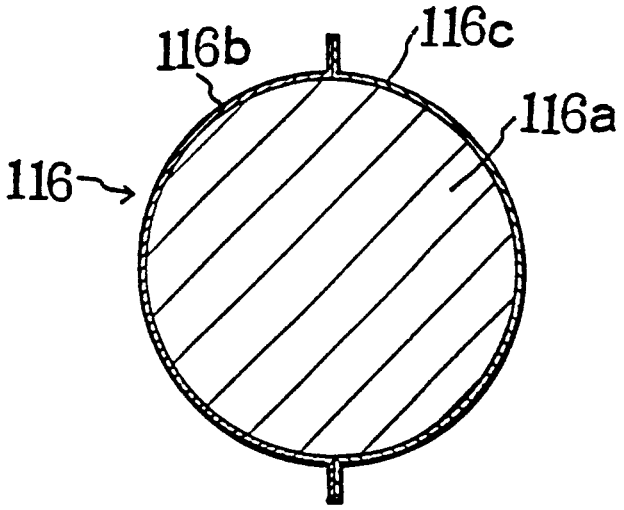
FIG. 8 is a sectional view of an embodiment of the floating member.

As shown in FIG. 8, each of the floating members 116 is formed of a cylindrical buoyant body 116*a* of foamed polystyrene or the like surrounded in a water-tight manner by a pair of semi-cylindrical flanged casing halves 116*b*, 116*c*.

The casing halves 116*b*. 116*c* are desirably formed of highly sea water resistant materials such as fiber-reinforced plastics, steel plate treated with anti-corrosive agent, stainless steel plate, sea water resistant aluminum or the like.

Figure 9:
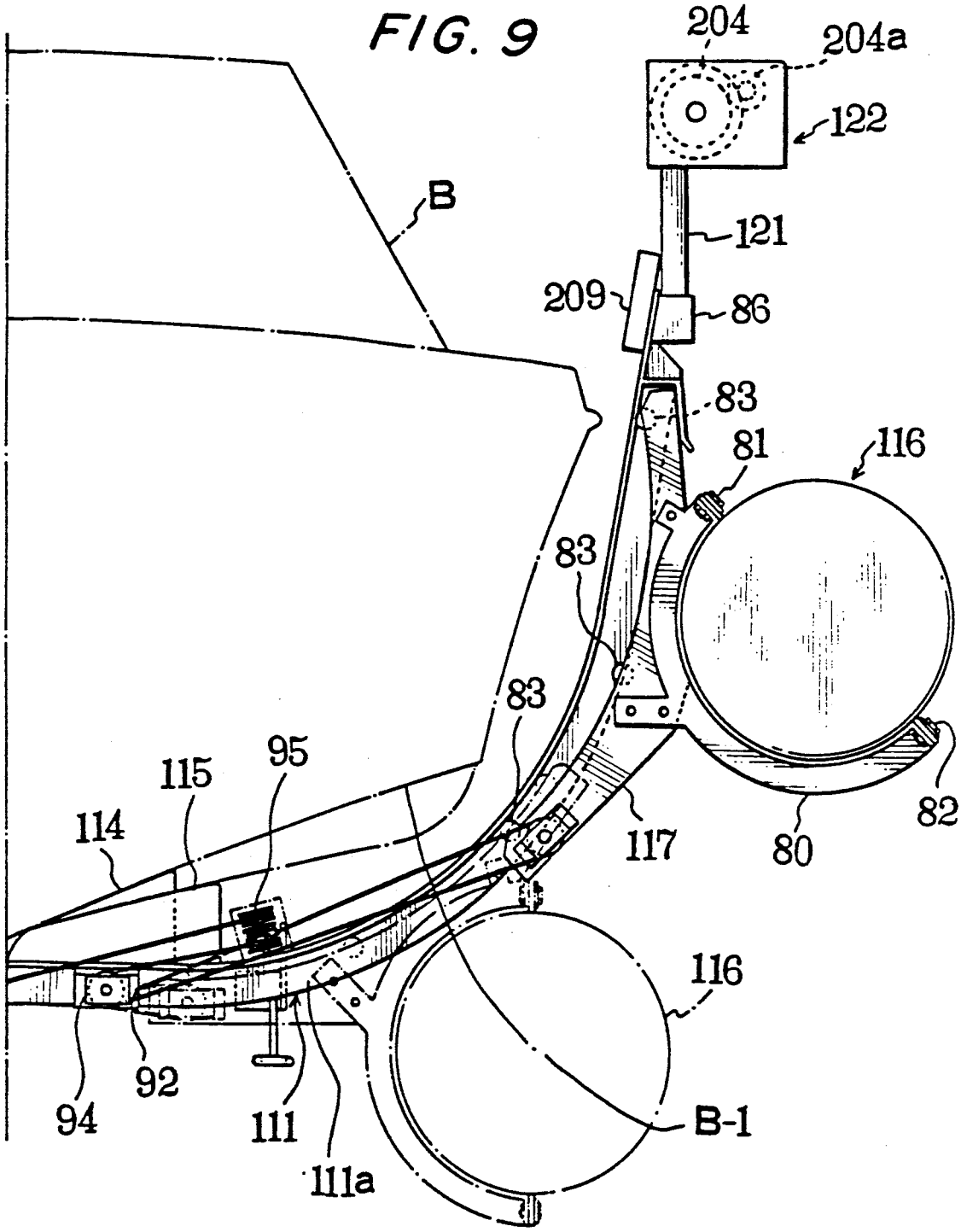
FIG. 9 is an enlarged view for explaining essential parts of a floating member guide construction.

The floating member 116 is detachably connected to a semicircular sliding member mounting frame 80 by connecting bolts 81, 82, as shown in FIG. 9.

On the other hand, sliding members 117, 118 for moving and guiding floating members 116 and which are formed from arclike plates having a shape substantially suited to the shape of left and right rising portions of the front and rear frame members 111, 112 are connected to the sliding member mounting frames 80, as shown in FIG. 9.

The sliding members 117, 118 have a plurality of sliding rings 83 mounted on the inner peripheral sides thereof so that they may slidably contact outer surfaces of the left and right rising portions of the front and rear frame members 111, 112, as shown in FIG. 9.

A plurality of small slider members (not shown) formed of hard rubber for restricting the lateral movement of the floating members 116 are mounted on the back of the sliding members 117, 118.

The sliding rings 83 contact rising portions 111*a*, 112*a* of the front and rear frame members 111, 112 Which are L-shaped in cross section, whereby movement of the sliding members 117, 118 and the floating members 116 carried thereby relative to the trestle body 110 in the lateral direction is positively prevented.

Accordingly, the floating members 116 are moved as shown in FIG. 6 by use of a trestle body elevating device S which will be described later whereby the trestle body 110 can be moved together with the small boat B to an upper position at which the water line is at L1 or a lower position at which the water line is at L2.

Stoppers 84, 85 are provided on upper portions of both rising portions of the front and rear frame members 111, 112 to thereby positively prevent the sliding members 117, 118 from being disengaged from the upper portions of both the rising portions of the front and rear frame members 111, 112 when the water line is at L2.

The stoppers 84, 85 are mounted vertically adjustably whereby the water line L2 can be adjusted (not shown).

Plates 208, 209 for guiding movement of a boat and also serving as reinforcing members are mounted between upper portions of both the rising portions of the front and rear frame members 111, 112.

The front and rear frame members 111, 112 may be of an inverse-U-shape or a hollow cylindrical or other sectional shape other than an angle shape (not shown).

The structure of the trestle body elevating device S for moving the floating members 116 downward and upward to elevate the trestle body 110 so that the water line is at L1 or lower the trestle body 110 so that the water line is at L2 will be described hereinafter.

As shown in FIG. 9, a laterally extending operating line casing 86 is mounted between upper ends of the rising portion on one side of the front and rear frame members 111, 112 of the trestle body 110. An elevating means supporting post 121 is stood upright on the upper surface of the side of the front frame member of the casing 86. An elevating means 122 in the form of a power-driven winch or the like is mounted on the upper end of the supporting post 121.

The elevating means 122 cooperates with operating lines 89, 90, 100, 101, 108 and 109 which will be described later to form the trestle body elevating device S and to move the floating members 116 between a position located at both sides of the trestle body 110 and a position located below the trestle body 110 so that the trestle body 110 may be elevated.

That is, the operating lines 89, 90 are wound about the pulleys 87, 88 provided below the sliding members 117 mounted on the front portion of the floating members 116 in FIGS. 9 and 10.

One end of each of the operating lines 89, 90 is tied to a respective central portion 91, 92 of the front frame member 111, while the other ends thereof are connected through pulleys 93, 94 provided in the central portion of the front frame member 111 to a movable frame 97 which extends rearwardly and which is integral with a pulley 96 comprising a running block which includes a multi-pulley 95.

On the other hand, the operating lines 100, 101 are wound about pulleys 98, 99 provided below the sliding members 118 mounted on the rear portion of the floating members 116 (see FIGS. 9 and 10).

One end of each of the operating lines 100, 101 is tied to respective central portions 102, 103 of the rear frame member 112 while the other ends thereof are connected to a bifurcated frame member 107 which extends rearwardly through pulleys 104, 105 provided in the central portion of the rear frame member 112 and through a composite pulley 106 made of a plurality of pulleys likewise provided in the central portion of the rear frame member 112.

The operating line 108 with one end connected to the bifurcated frame member 107 has the other end extended forwardly and wound about the composite-pulley 95 made of a plurality of pulleys provided on the upper surface of the front frame member 111, after which the line is connected to the movable frame 97 integral with the pulley 96.

Figure 10:
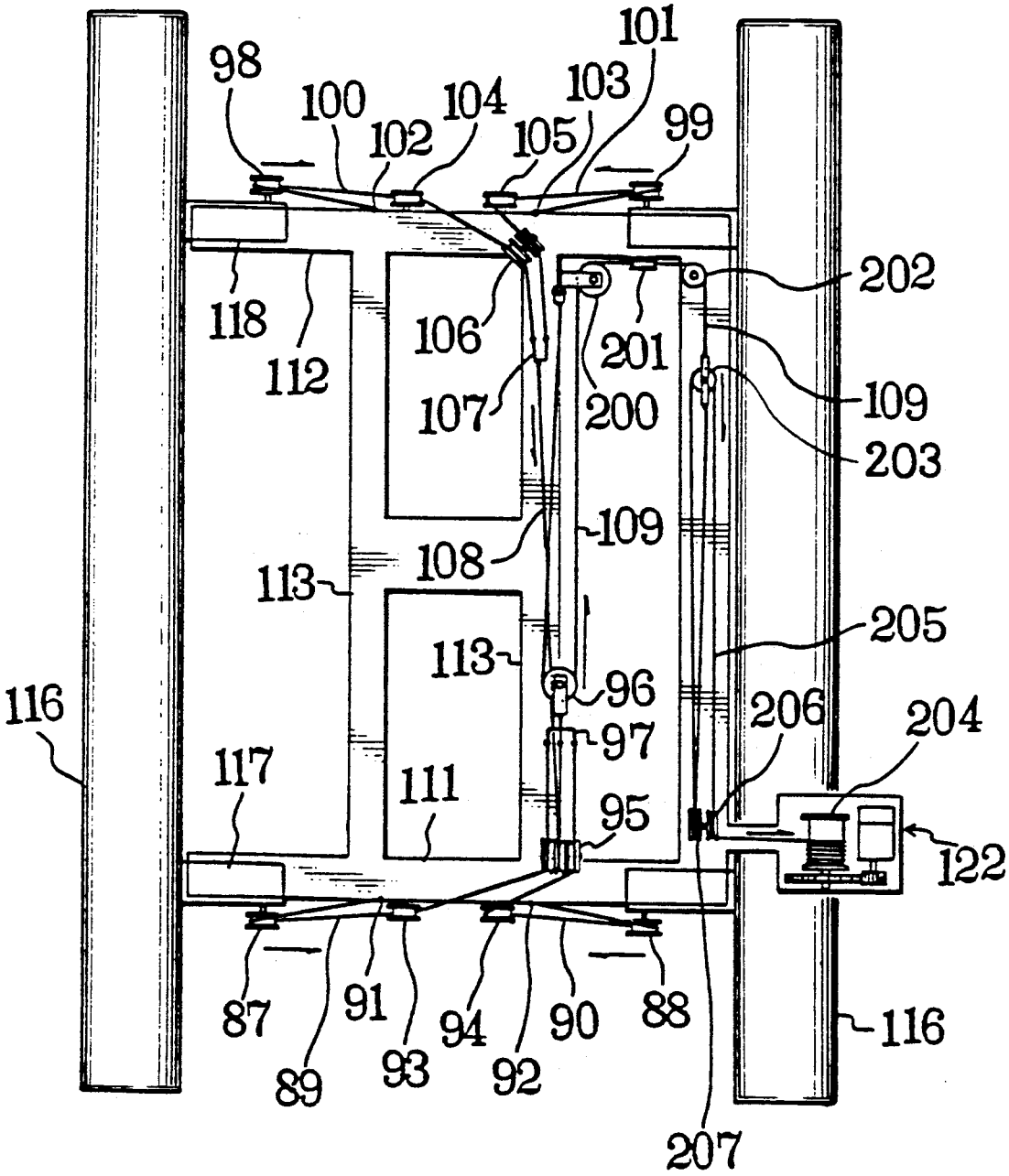
FIG. 10 illustrates the state of operating lines of the floating dock during elevating of the trestle body.

Reference number 109 designates an operating line which has one end connected to one side of the rear frame member 112, while the other end thereof is extended forwardly and wound about the pulley 96, after which it extends within the operating line casing 86 through pulleys 200, 201 provided on one side of the rear frame member 112, as shown in FIG. 10.

The operating line 109 is guided by the pulley 202 within the operating line casing 86, after which the other end thereof is connected to a pulley 203 in the form of a running block.

An operating line 205 having one end connected to a winch drum 204 constituting an elevating means 122 is wound about the pulley 203 while the other end thereof is wound through a pulley 206 provided frontwardly of the operating line casing 86, after which said other end is wound about a pulley 207 provided frontwardly of the operating line casing 86, after which it is tied to the pulley 203. Reference numeral 204*a* denotes an electric motor.

With the construction as described above, when the elevating means 122 is operated, various operating lines 89, 90, 100, 101, 108, 109 and 206 can be wound and loosened, whereby similarly to the first embodiment, the floating members 116 can be moved up and down along the outer surfaces of the front and rear frame members 111, 112 to easily lift the trestle body so that the water line is at L1 or lower the trestle body so that the water line is at L2 shown in FIG. 6.

In FIGS. 7 and 10 the trestle body is shown with an H-frame between the front and rear frame members.

The floating dock C according to the second embodiment has the same advantages as the first embodiment.

In addition, the second embodiment has other characteristics peculiar thereto as follows:

(1) Unlike the case of the first embodiment, the floating member 116 need not be provided in its peripheral surface with the ring groove 50 and the line guide groove 51*a* for preventing disengagement of a floating member. Therefore, the rigidity of the floating member 116 can be greatly enhanced, and the strength can be increased.

(2) Since the floating member 116 can be formed merely in a manner such that the floating member body 116*a* is surrounded by a pair of casing halves 116*b*, 116*c*, it is possible to manufacture the floating member 116 at less cost.

(3) By use of the sliding members 117 and 118, the elevating operation of the floating members 116, that is, the work of placing the trestle body 110 at upper and lower positions can be easily and positively accomplished.

(4) Since the operating lines 89, 90, 100 and 101 do not rub the outer surfaces of the front and rear frame members 111, 112 of the trestle body 110, it is possible to minimize the injuring of the frame members 111, 112 of the trestle body 110.

(5) The flanges of the floating member 116 in water provides a resistance against rolling caused by wind and waves and can also serve as a stabilizer, which is an advantage thereof.

While the present invention has been described with reference to two embodiments, it is to be noted that the present invention is not in any way limited to the above-described embodiments.

I claim:

1. A floating dock comprising a trestle body including substantially semi-circular front and rear mutually parallel frame members adapted to cradle a boat, at least one float member mounted on the exterior of each frame member on opposite sides of a plane of symmetry of the trestle body, said plane of symmetry being vertical and extending lengthwise of the trestle body, means mounting the float members relative to the frame members for sliding of the float members on the frame members, means for moving the float members relative to the frame members in sliding engagement with the frame members between positions on the frame members alongside the trestle body so that the float members extend laterally beyond the width of the trestle body and positions underneath the trestle body so that the trestle body extends laterally beyond the float members and the float members support the trestle body above the water line, and means for fixing the float members relative to the frame members at the respective positions.

2. A floating dock according to claim 1, in which the trestle body further includes an H-shaped frame respective pairs of ends of which are connected to the respective front and rear frame members with the plane of the frame horizontal and said plane of symmetry bisecting the frame.

3. A floating dock according to claim 2, further including arcuate members mounted on the float members, sliding members carrying the arcuate members and the sliding members including means for slidingly engaging the frame members.

4. A floating dock according to claim 1, in which said means for moving the float members comprises an upright member mounted at an end of one of said frame members, means mounted on said upright member for taking up and letting out an operating line, pulleys mounted on the trestle body, the operating line engaging the pulleys and the float members so that taking up and letting out of the operating line by the taking up and letting out means moves the floating members to and fro between said respective positions thereof.

* * * * *